United States Patent [19]

Glöyer

[11] Patent Number: 4,930,633

[45] Date of Patent: Jun. 5, 1990

[54] MULTIPLE PACK FOR A PLURALITY OF CYLINDRICAL CONTAINERS

[76] Inventor: Wolfgang Glöyer, Wiesenweg 51, D-2000 Oststeinbek, Fed. Rep. of Germany

[21] Appl. No.: 102,820

[22] Filed: Sep. 22, 1987

Related U.S. Application Data

[63] Continuation of Ser. No. 777,984, filed as PCT DE85/00013 on Jan. 18, 1985, published as WO85/03274 on Aug. 1, 1985.

[30] Foreign Application Priority Data

Jan. 20, 1984 [DE] Fed. Rep. of Germany ..... 3401884
Oct. 20, 1984 [DE] Fed. Rep. of Germany ..... 8430925

[51] Int. Cl.[5] ..... B65D 61/00

[52] U.S. Cl. ..... 206/428; 206/427; 206/432

[58] Field of Search ..... 206/597, 428, 430, 432, 206/427

[56] References Cited

U.S. PATENT DOCUMENTS

| | | | |
|---|---|---|---|
| 2,290,969 | 7/1942 | King | 206/434 |
| 2,313,731 | 3/1943 | Brogden | 206/428 |
| 2,811,250 | 10/1957 | Arneson | 206/434 |
| 2,888,135 | 5/1959 | Guyer | 206/434 |
| 2,982,400 | 5/1961 | Andre | 206/428 |
| 2,986,272 | 5/1961 | Kruse | 206/434 |
| 3,123,214 | 3/1964 | McReynolds, Jr. | 206/434 |
| 3,358,828 | 12/1967 | Tolaas | 206/434 |
| 3,451,543 | 6/1969 | Graser et al. | 206/434 |
| 3,454,156 | 7/1969 | Chatten | 206/428 |
| 3,759,378 | 9/1973 | Werth | 206/429 |
| 3,897,872 | 8/1975 | Graser | 206/434 |
| 4,269,314 | 5/1981 | Barrash | 206/428 |
| 4,301,922 | 11/1981 | Hamelin et al. | 206/428 |
| 4,460,084 | 7/1984 | Miller | 206/428 |
| 4,566,593 | 1/1986 | Muller | 206/434 |

FOREIGN PATENT DOCUMENTS

| | | | |
|---|---|---|---|
| 93302 | 4/1983 | European Pat. Off. | 206/428 |

*Primary Examiner*—Joseph Man-Fu Moy
*Attorney, Agent, or Firm*—Antonelli, Terry, Stout & Kraus

[57] ABSTRACT

A multiple pack for a plurality of cylindrical containers of uniform design and size arranged in at least two longitudinal rows in juxtaposed upright manner. The multiple pack envelope comprises a rectangular cardboard blank in the form of a strip provided with transverse folding lines. The stripe-like blank forms a base surface and two facing, upwardly foldable side or end wall surfaces joined to the base surface and having a height the same as or less than the height of the containers. A surrounding band crossing the upwardly folded side or end wall surfaces and the two uncovered ends or sides of the multiple pack at approximately the midpoint of the container height acts as the sole means for holding together of and for one or two-handed carrying of the multiple pack.

8 Claims, 5 Drawing Sheets

MULTIPLE PACK FOR A PLURALITY OF CYLINDRICAL CONTAINERS

This application is a continuation of application Ser. No. 777,984, filed as PCT DE85/00013 on Jan. 18, 1985, published as WO85/03274 on Aug. 1, 1985.

BACKGROUND OF THE INVENTION

A multiple pack according to the invention is suitable as a handy, palletizable, stackable package for a relatively large number of containers of uniform design and size during transportation and storage, as well as being suitable as a sales, viewing and stock pack. The pack permits rapid and economic combining of such containers by packaging machines. The containers can consist of cans and containers with a cylindrical shape and having circular, elliptical or polygonal cross-sections, but can also be bottles, which are cylindrical over at least part of the height of their outer casing. A preferred field of use for the invention is the distribution of beverages in liquid containers. However, containers for other products, such as e.g. canned food, detergents or motor oils can be combined into multiple packs according to the invention.

It is known to combine a plurality of cylindrical containers of the same design and size into at least two longitudinal rows of juxtaposed, standing containers so as to give a multiple pack. Hitherto such a multiple pack has mainly consisted of an envelope in the form of a folding box, which was produced from a cardboard blank provided with fold lines. The production of such a folding box required a relatively large amount of cardboard material and a large number of working processes. In addition, the cardboard material had to be provided with openings, if it was necessary to have handles for carrying the multiple pack with one or both hands.

SUMMARY OF THE INVENTION

The invention relates to a multiple pack for a plurality of cylindrical containers of uniform design and size arranged in at least two longitudinal rows in juxtaposed upright manner and formed from with a substantially rectangular cardboard blank in the form of a strip or band provided with transverse folding lines.

The problem of the invention is to provide an approximately parallelepipedic, easily manually carryable multiple pack which can be stacked on pallets and the like, enabling at least part of the circumferential surface of the containers to be seen from the outside, which requires extremely little manufacturing expenditure and which is suitable for high speed mechanical filling with the containers.

According to the invention this problem is solved by a multiple pack of the aforementioned type constructed in such a way that the strip forms a base surface on which the containers stand, and two facing, upwardly foldable side or end wall surfaces joined by transverse folding lines to the base surface, that the height of the upwardly folded side or end wall surfaces is the same or less than the height of the containers and that a surrounding band crossing the upwardly folded side or end wall surfaces and the two uncovered sides of the multiple pack at roughly half the height of the containers is the sole means for holding together, and also for one or two-handed carrying of, the multiple pack.

Such a multiple pack also has the advantage that it can be opened relatively easily, without using tools and without destroying the cardboard or corregated paper material, and that after removing the containers the packaging material can be collapsed in a space-saving manner and, if desired, can be reused.

The rectangular strip of the cardboard blank can have further surface parts which extend over the facing side surfaces and which are joined to the side or end wall surfaces by further fold lines, and said further surface parts can be used for forming a cardboard envelope open at both sides and surrounding the containers in an annular manner. This makes it possible to provide constructions of a parallelepipedic multiple pack, which are covered at four annularly connected sides and open at two facing sides.

The length of the parts of the cardboard blank forming the base surface or container standing surface is preferably smaller than the sum of the diameters of the containers arranged in a longitudinal row. This ensures that the surrounding band is kept taut when engaged on the multiple pack, and also saves cardboard material.

To prevent unintentional slipping of the surrounding band, the facing terminal edges of the side or end wall surfaces of the blank can be provided with notches or cutouts for supporting the surrounding band.

BRIEF DESCRIPTION OF THE DRAWINGS

Further possibilities for the advantageous development of the invention are described hereinafter relative to embodiments and the attached drawings, wherein:

FIG. 2 is a plan view of the multiple pack in the finished state, i.e. with the blank folded in.

DETAILED DESCRIPTION OF THE INVENTION

Figure 1:
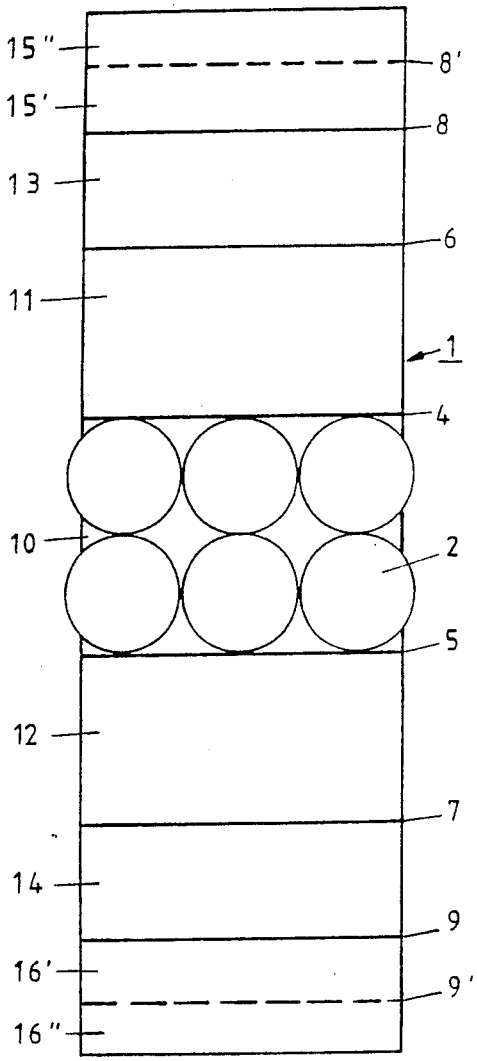
FIG. 1 is a plan view of a multiple pack according to the invention with the cardboard or currugated paper blank opened out.
Figure 2:
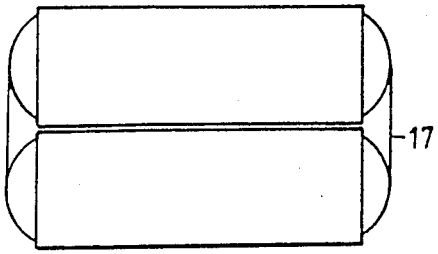
Figure 3:
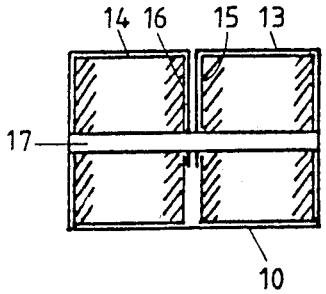
FIG. 3 is a side view of the multiple pack according to FIG. 2 viewed from the right.

As is diagrammatically shown in FIGS. 1 to 4, the multiple pack formed by blank 1 surrounds a group of juxtaposed, standing containers arranged in two rows in the transverse direction of the strip-like blank, thw two rows having the same dimensions and being formed of cylindrical cans. Blank 1 comprises an elongated, rectangular cardboard or corrugated paper strip provided with transverse folding lines 4 to 9. The central surface part 10 of the strip forms a rigid base carrying containers 2. This is bounded on the longitudinal sides of the container rows by transverse folding lines 4, 5. To these are connected upwardly foldable surface parts 11, 12, whose lengths correspond to the height of the containers 2. In the upwardly folded state, surface parts 11, 12 in each case form one end wall of the multiple pack. The surface parts 13, 14, connected respectively to surface parts 11, 12, in each case form a part of the cover wall of the multiple pack, and the outermost surface parts 15', 15'', 16', 16'' of blank 1, connected thereto, fold up in the end state as depicted in FIGS. 2 and 3, to form transverse walls 15, 16, which subdivide the space within the multiple pack in the manner of a "double ring insert" and reinforce the same. The annular shape in this case is subdivided in the manner of a double ring insert of the multiple pack formed by the blank and when in the final state is held together by a surrounding band 17, without having to be fixed thereto by bonding or the like, so that it is possible to grip between band 17 and the containers on one or both sides of the multiple pack, so that the latter can be raised and carried with one or both hands. The band 17, holding together the multiple pack, is consequently simultaneously usable as a carrying handle, provided that the total weight of the multiple pack with contents does not exceed that of a piece of hand luggage. The band 17, crossing the two open sides of the annularly or spectacle-shaped folded-in blank 1, simultaneously prevents the containers in contact therewith from laterally sliding out or dropping out of the pack. Band 17 can be made from transparent or at least translucent plastic, so that it scarcely impedes viewing from the side on to the circumferential walls of the containers or the inscriptions thereon. Blank 1 of the multiple pack is appropriately made from one or two-layer corrugated paper or board, which ensures a completely adequate strength.

Such a multiple pack has in particular the following advantages. Its production from a blank in the form of an elongated strip is particularly simple, involves little material expenditure and leaves behind no waste. The waste remaining after the use of such a pack can be eliminated easily and rapidly. The visibility of the multiple pack contents, in certain circumstances, makes it unnecessary to label the same, whilst glueing and punching processes are not required. The multiple pack can easily be picked up, carried and placed on a pallet or the like with one or both hands. Due to the fact that the cover wall halves 13, 14 and the partition halves 15, 16 are folded down on folding lines 6, 7, along side walls 11, 12 and in each case half of the base wall 10, a rigid, double-layer display with U-shaped, upright end walls can be obtained on which the individual containers 2 are freely accessible and from which they can easily be individually removed and, if desired, can then be reinserted.

Instead of using the multiple pack for containers with a circular cross-section, it is also possible to advantageously use the same for containers with a square, polygonal or oval cross-section. The containers can be arranged in parallel rows both along the extension of the strip-like blank and also at right angles to the longitudinal direction of the strip-like cross-section. The containers can be fundamentally juxtaposed in upright manner in parallel longitudinal and transverse rows. In certain circumstances it can be advantageous to have more containers in, in each case, one transverse row, instead of in a longitudinal row, based on the longitudinal direction of the blank.

The use of the multiple pack for containers not having a circular ground plan shape permits particularly good space utilization. Instead of cans or wide-necked bottles (with tops sealed), it is also possible to combine other shaped bottles or canisters into a multiple pack according to the invention.

The embodiment of the invention diagrammatically illustrated by FIGS. 1 to 4 is particularly suitable for a multiple pack of six food cans made from sheet metal and having a content of in each case 850 ml, or e.g. for 6 plastic paint cans with in each case a content of 750 ml. The transverse folding lines are in this case scored, i.e. produced by a tool penetrating the blank material in rolling manner. The width of the blank 1 is in this case, measured in the direction of the transverse folding lines 4 to 9, smaller than the sum of the diameters of the containers 2 arranged in one row parallel to said transverse folding lines 4 to 9. Thus, the containers 2 at the ends of in each case one transverse row project outwards somewhat over the blank, so that the surrounding band 17, as shown in FIG. 2 particularly, securely holds the containers. The reduced width of the strip-like blank 1 also leads to saving of blank material, which is a not inconsiderable economic advantage during the mass production of multiple packs.

The surface parts 13, 14 of the blank forming the cover wall parts have a length corresponding to the container diameter. The outermost surface parts 15, 16 of the blank connected thereto are, as shown in FIG. 3, insertable between two container rows, so that in each case they together form an intermediate layer, into which can be pressed the periphery or a closing edge of containers 2 engaging therewith, under the action of forces transferred by the surrounding band 17. This also leads to a particularly firm hold of the containers within the multiple pack.

Figure 4:
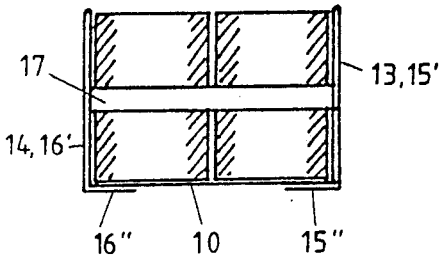
FIG. 4 is a side view of the same multiple pack with the blank partly folded back as a display.

The two outermost surface parts 15, 16 of the rectangular blank 1 are here partitioned by an additional transverse folding line 8' or 9', shown in broken line form. The position of this additional transverse folding line is chosen in such a way that, measured in the longitudinal direction of the blank, one partitioning portion 15' or 16' and the adjacent surface part 13 or 14, forming a cover wall part, together have a length corresponding to the length of the surface parts 11 or 12 forming the end walls. Thus, as shown in FIG. 4, it is possible to fold on to the adjacent end wall 11 or 12 so as to double the thickness thereof one partitioning portion 15' or 16' and its adjacent surface part 13 or 14, forming a cover wall part, and to place the in each case other outermost partitioning portion 15'' or 16'' under the multiple pack base 10 in order to form a multiple pack display which is accessible from the top.

According to FIG. 3, the outermost surface parts 15, 16 of the blank can be inserted between two container rows, so that together they form an intermediate layer.

Figure 6:
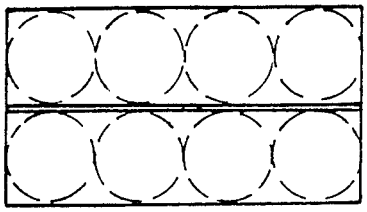
FIGS. 5 and 6 depict a further embodiment in views corresponding to those of FIGS. 1 and 2, namely in ground plan of the multiple pack with the blank opened out and in ground plan of the finished multiple pack.
Figure 5:
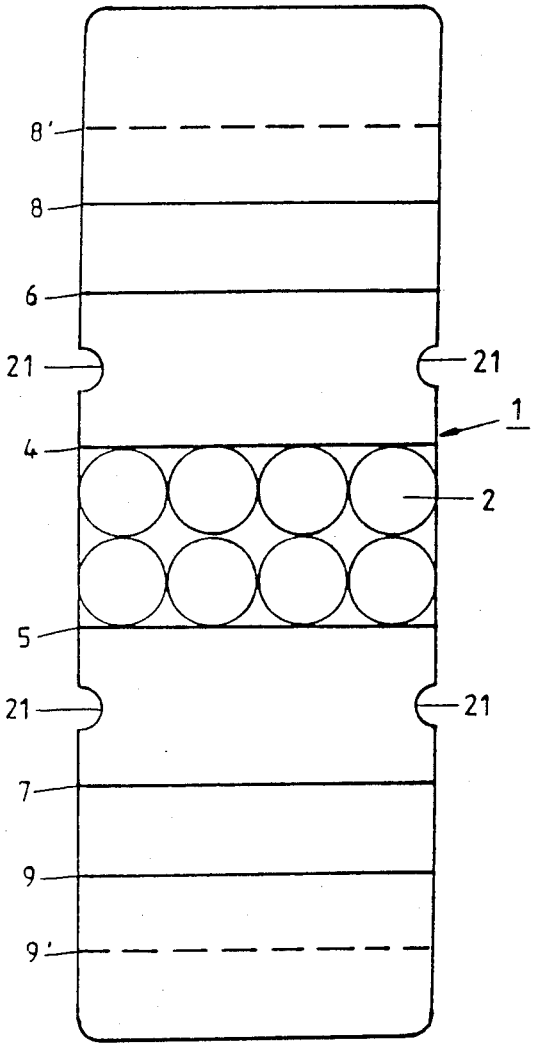

FIGS. 5 and 6 illustrate a further embodiment, which is particularly suitable for eight plastic motor or engine oil cans with, in each case, a capacity of one litre. A special feature of this embodiment is that the facing edges of the surface parts 11, 12 of the blank forming the end walls are provided with indentations 21 for supporting the surrounding band 17. This prevents an unintentional displacement of the surrounding band and ensures a firm engagement on the containers, even if they are not intended to project on either side over the width of the blank strip.

Figure 7:
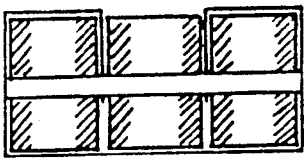

Moreover, this embodiment, like that described hereinbefore in connection with FIGS. 1 to 4, gives a high rigidity and strength (static) of the multiple pack, even if the outermost surface parts 15, 16 inserted between two container rows terminate at a certain distance from the bottom of the pack formed by the central surface part 10 of the strip-like blank and as shown e.g. in FIGS. 3 and 7. In the same way as the transverse folding lines, the indentations 21 on the edges of the blank can be produced by means of punching tools.

Figure 10:
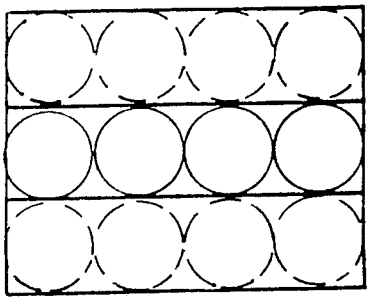
Figure 8:
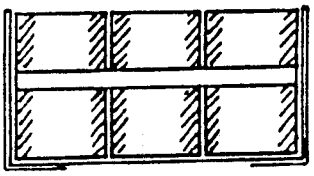
FIGS. 7 and 8 depict a side view of another embodiment of a finished multiple in, respectively a folded in state and a folded back state as a display.

A special feature in the case of FIGS. 7 and 10 is that in this case the outermost surface parts of the blank can in each case be inserted between two different containers rows, so that they in each case individually form an intermediate layer or wall into which adjacent containers can press with their periphery or closing edge under the action of forces emanating from the surrounding band, so that the multiple pack has a high strength. As shown in FIG. 8, in this embodiment the outermost surface parts can be folded rearwards beneath the base, so that it is possible to produce a stiff, double-layer display with U-shaped upright end walls.

Figure 9:
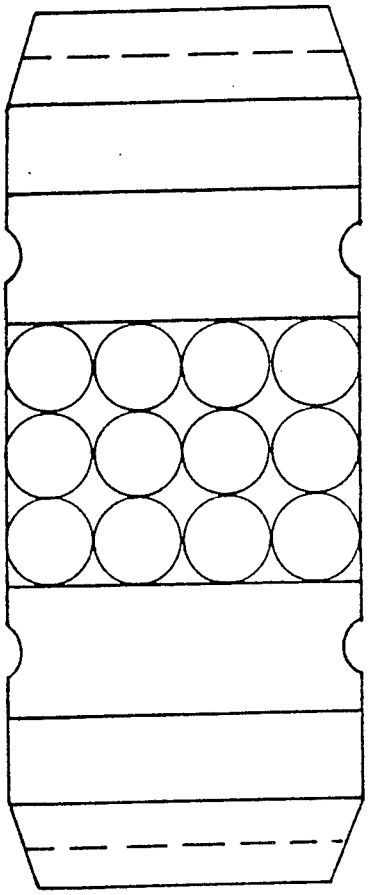
FIGS. 9 and 10 depict a ground plan of the same embodiment in, respectively, the opened out state of the blank, with containers standing thereon, and the finished multiple pack.

FIGS. 9 and 10 show another embodiment of a multiple pack according to the invention for twelve beverage cans arranged in three rows, but with a punched or stamped cardboard or corrugated paper blank and indentations on the blank edges, as described hereinbefore relative to the embodiment of FIGS. 5 and 6 which also has a punched blank.

A special feature of this embodiment is that the central of the three container rows remains accessible from the top even when the pack is closed and individual cans can be removed therefrom or reinserted therein when the pack is closed. Independently thereof, the possibility also exists in this embodiment of converting the multiple pack into a display, in which all the cans are accessible from the top.

A multiple pack according to the invention can also be enveloped with a thin-walled shrinkable or extensible foil (not shown) providing protection against moisture and dust, which can in particular be advantageous during transportation. In certain circumstances it can be advantageous to locate the surrounding band outside the shrinkable or extensible foil.

Figure 11:
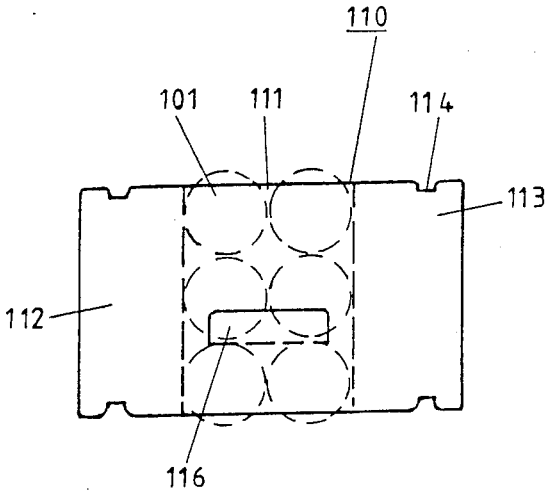
FIG. 11 is a ground plan of the blank of the cardboard envelope of a further embodiment of a multiple pack according to the invention for six containers.
Figure 12:
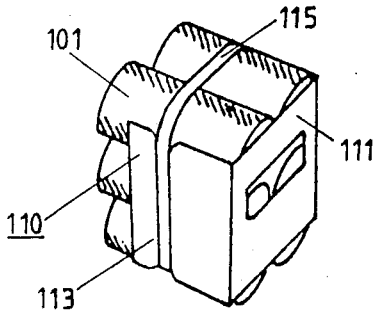
FIG. 12 is a perspective view of the same multiple pack, with a free view of the underside of the base surface of the blank.
Figure 14:
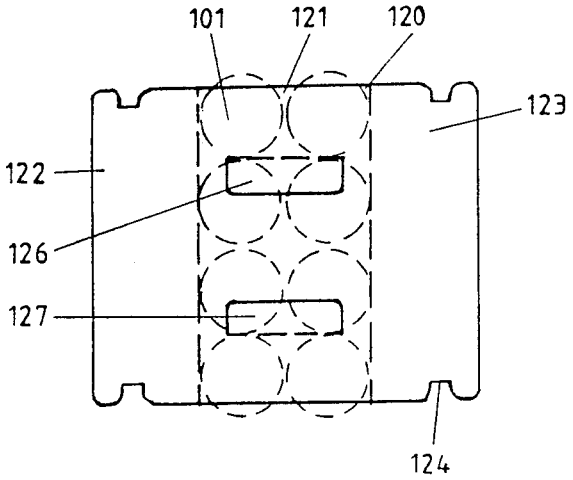
FIG. 14 is a plan view of the cardboard blank of another embodiment of a multiple pack according to the invention for eight cylindrical containers in two longitudinal rows and in juxtaposed standing manner.
Figure 13:
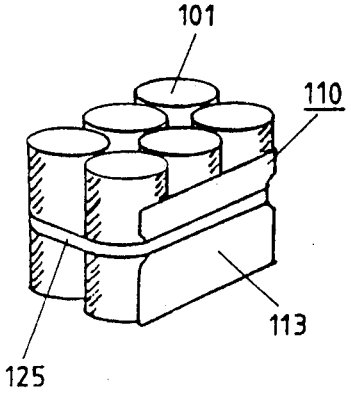
FIG. 13 is a perspective view of the top of the same multiple pack.

FIGS. 11 to 13 show a particularly advantageous embodiment, which on the one hand requires an extremely small cardboard material surface, while still having a particularly high natural rigidity, whilst on the other hand ensuring high security against slipping or sliding of the containers during the loading and transportation of the multiple pack. The cardboard blank 110 for forming the cardboard envelope includes a base surface 111 on which the cylindrical containers 101 are arranged in juxtaposed standing manner in two longitudinal rows. In FIGS. 11 and 14 the containers are indicated by broken lines. Blank 110 further includes side wall surfaces 112 and 113, whose height is less than the container height as shown in FIG. 12, or, at the most, is the same as said height. The length of the side wall surface and the length of the base surface are less than or, at the most, the same as the sum of the diameters of the containers arranged in one longitudinal row in the multiple pack. The lateral terminal edges of the side wall surfaces are provided with cutouts and/or recesses 114 for securing the surrounding band 115. In the base wall 111 is provided an elongated flap 116, formed therefrom with a fold running in the direction transverse to the longitudinal rows of containers. When folded up by 90°, flap 116 forms a transverse web preventing the longitudinal sliding of the containers arranged in the different longitudinal rows, which engages on circumferential surfaces of adjacent containers and also leads to a stiffening of the base surface. The width of the flap 116 is at least sufficient to ensure that four containers, namely two on either side, are contacted by the transverse web formed by it, but it is smaller than the width of the base surface 121. The surrounding band 115, which holds together the pack, is secured by the recesses 114 in the lateral terminal edges of side wall surfaces 112, 113 in such a way that it cannot move along the cylindrical containers. Due to the fact that the length of the side wall surfaces 112, 113, as well as the length of the base surface 111, is somewhat smaller than the sum of the diameters of the containers arranged in a longitudinal row, it is ensured that the surrounding band is adapted to the rounded configuration of the outermost containers. This also leads to a saving of cardboard material. In place of a recess 114, cutouts can be provided in a lateral terminal edge of the side wall surface with a spacing of roughly the width of the surrounding band 115. In the extreme case, as shown in FIG. 12, the height of the side wall surfaces 112, 113 can be the same as the height of containers 101. However, it is adequate if the height of the side wall surfaces only takes up part of the height of the containers, as shown in FIG. 13.

Figure 15:
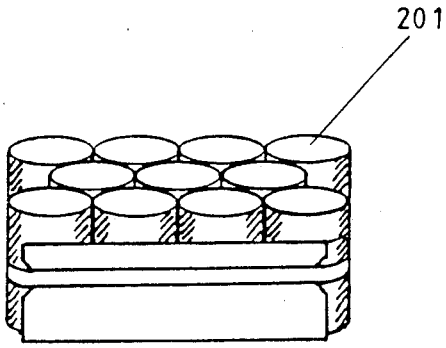
FIG. 15 is a perspective view of yet another embodiment of a multiple pack according to the invention, with a particularly narrow base wall surface.
Figure 16:
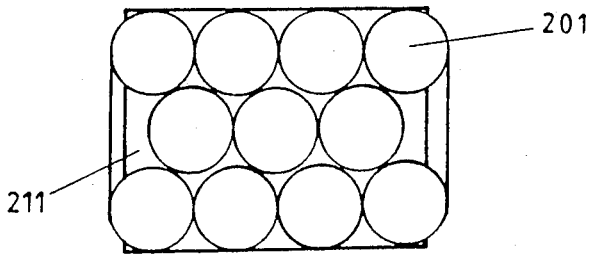
FIG. 16 is a ground plan of the same multiple pack.

The embodiment according to FIG. 14 differs from that described in accordance with FIGS. 11 to 13 mainly in that the blank 120 is intended for eight containers 101, instead of for six containers as in FIGS. 11 to 13. Moreover, in this case, there are two elongated flaps 126, 127 stamped from base wall 121 with a fold running in the transverse direction. When folded up by 90°, they in each case form a transverse web for preventing the sliding of the containers and for reinforcing the base surface. The embodiment according to FIG. 14 includes side wall surfaces 122, recesses 124 in the terminal edges of surfaces 122 and 123, and strap 125. Due to the greater length of the two longitudinal containers rows, in the embodiment according to FIG. 14 there are two transverse webs formed by flaps in the base wall, so that when viewed in the transverse direction there is a symmetrical arrangement thereof, which leads to better stiffening and securing against sliding. However, normally one transverse web, which can be arranged asymmetrically as shown in FIGS. 11 to 13, is sufficient. A particularly advantageous and particularly space and cardboard material-saving embodiment is shown in FIGS. 15 and 16. In this case the cylindrical containers 201, standing on base surface 211, are arranged in three parallel longitudinal rows in such a way that the axes of the containers of the two outer rows are aligned pairwise in a plane at right angles to the longitudinal direction of the rows. The containers of the central row are staggered in the longitudinal direction of the row with respect to the containers of the outer rows by, in each case, half the container diameter. The two outer container rows are positioned so close to the central container row that each container of the central row is in contact with two containers in each of the outer rows. It is clear that in this way the base surface of the pack, on which the containers stand, can be made somewhat narrower than in the previously described embodiments. This can be very advantageous in certain circumstances for obtaining palletizable, stackable multiple packs, because in this way the narrow side of the rectangular ground plan of the multiple pack can be made even smaller.

I claim:

1. A multiple container package comprising:

a plurality of cylindrical rigid containers of uniform design, shape and size, each container having a substantially planar bottom surface;

a support envelope for said containers formed of a substantially rectangular cardboard blank in the form of a longitudinal strip having two transverse folding lines positioned to define a planar base surface, upon which the containers are arranged in juxtaposed upright manner in a plurality of parallel rows arranged parallel to said transverse folding lines with the planar base surface lying below the bottom surfaces of the containers, the planar base surface having therein at least one U-shaped cut with an associated longitudinally directed fold line to define at least one elongated flap, each said flap folded up by 90° to position one such flap between two adjacent containers in each row, thereby preventing transverse sliding of the containers in said parallel rows and stiffening the base surface; and two side or end wall surfaces connected by the transverse folding lines to the base surface and folded upwardly to define the cardboard support envelope with two opposite ends or sides of the containers uncovered, the height of the upwardly folded side or end wall surfaces being the same as or less than the height of the containers so that the tops of the containers are uncovered, the transverse length of both the base surface and the upwardly folded side or end wall surfaces being less than the sum of the diameters of the containers in at least one of said rows of containers so that the uncovered surfaces of the containers at the two ends of said at least one row extend partially beyond the planar base surface and upwardly folded end or side wall surfaces; and a surrounding band member held under tension and extending across the containers at the uncovered ends or sides of the container package and along the upwardly folded side or end wall surfaces of the package at approximately the mid-point of the height of the containers, the band holding the containers within the package and being usable as the sole means for holding the package together and for one or two-handed carrying of the package.

2. A multiple container package according to claim 1, in which the longitudinal edges of the defined side or end wall surfaces have notches or cutouts therein and the surrounding band is positioned in the notches or cutouts.

3. A multiple container package according to claim 1, further comprising a thin-walled shrinkable or extensible foil enveloped about the support envelope and containers so as to provide protection against moisture and dust.

4. A multiple container package according to claim 3, in which the surrounding band is fitted outside the shrinkable or extensible foil.

5. A multiple container package according to claim 1 in which the containers are arranged in three parallel rows.

6. A multiple container package according to claim 1 in which said support envelope planar base surface has therein two U-shaped cuts, each with an associated longitudinally directed fold line, to define two elongated flaps.

7. A multiple container package as claimed in claim 6 in which the two U-shaped cuts are displaced from each other in the transverse direction of said longitudinal strip to position the two flaps between transversely displaced sets of adjacent containers.

8. A multiple container package comprising:

a plurality of cylindrical rigid containers of uniform design, shape and size, each container having a substantially planar bottom surface;

a support envelope for said containers formed of a substantially rectangular cardboard blank in the form of a longitudinal strip having two transverse folding lines positioned to define a planar base surface and two side or end wall surfaces, with said containers arranged on said base surface in juxtaposed upright manner in three parallel rows extending parallel to said transverse folding lines with the planar base surface lying below the bottom surfaces of said containers, and with the axes of the containers of the two outer rows aligned pairwise in planes at right angles to the direction of said parallel rows, the containers of the central row being staggered by half of a container diameter in the direction of the rows with respect to the containers of the outer rows, and with the two outer container rows positioned so that each container of at least one of the rows contacts two containers in each adjacent row; said two side or end wall surfaces being connected by the transverse folding lines to the base surface and folded upwardly to define the cardboard support envelope with two opposite ends or sides of the containers uncovered, the height of the upwardly folded side or end wall surfaces being the same as or less than the height of the containers so that the tops of the containers are uncovered, the transverse length of both the base surface and the upwardly folded side or end wall surfaces being less than the sum of the diameters of the containers in at least one of said rows of containers so that the uncovered surfaces of the containers at the two ends of said at least one row extend partially beyond the planar base surface and upwardly folded end or side wall surfaces; and a surrounding band member held under tension and extending across the containers at the uncovered ends or sides of the container package and along the upwardly folded side or end wall surfaces of the package at approximately the mid-poiknt of the height of the containers, the band holding the containers within the package and being usable as the sole means for holding the package together and for one or two-handed carrying of the package.

* * * * *